United States Patent [19]

Kuo

[11] Patent Number: 4,773,100

[45] Date of Patent: Sep. 27, 1988

[54] WELL-SHIELDED RAIN CLOTHES

[76] Inventor: Ming-Tsen Kuo, P.O. Box 10160, Taipei, Taiwan

[21] Appl. No.: 79,711

[22] Filed: Jul. 30, 1987

[51] Int. Cl.[4] ..... A41D 27/10; A41D 1/06; A41D 3/08; A41D 19/00

[52] U.S. Cl. ..... 2/46; 2/70; 2/79; 2/88; 2/82; 2/227; 2/232; 2/159

[58] Field of Search ..... 2/82, 84, 88, 227, 232, 2/232 A, 46, 79, 70, 159, 160

[56] References Cited

U.S. PATENT DOCUMENTS

| | | | |
|---|---|---|---|
| 492,643 | 2/1893 | Van Oostrum | 2/232 A UX |
| 2,274,270 | 2/1942 | Kalb | 2/232 UX |
| 2,480,276 | 8/1949 | Wilkenfeld | 2/232 |
| 3,496,572 | 2/1970 | Herzig | 2/232 |
| 4,017,910 | 4/1977 | Bente | 2/232 |
| 4,258,438 | 3/1981 | Kirchner | 2/46 |

FOREIGN PATENT DOCUMENTS

| | | | |
|---|---|---|---|
| 1435980 | 3/1966 | France | 2/232 |
| 2076842 | 10/1971 | France | 2/232 |

*Primary Examiner*—H. Hampton Hunter

[57] ABSTRACT

A rain clothes includes a rain jacket having a pair of gloves built in two jacket sleeves ready for wearing service, and a rain trousers having a pair of leg hoses each having a lining of elastic hose portion and a skirt fastened to a wearer's shoe or foot for completely shielding a wearer's boot and foot.

6 Claims, 5 Drawing Sheets

WELL-SHIELDED RAIN CLOTHES

BACKGROUND OF THE INVENTION

A conventional rain coat includes a pair of sleeves each having an opening formed on the sleeve end, which may penetrate rain water into the sleeve to wet a wearer's hand. Even the rain-coat wearer may also wear gloves in a cold weather to prevent the cold rain-water attack in a rainy winter day, however, the rain water may still penetrate through an aperture between the wearer's glove and the raincoat sleeve to wet the wearer's hand to make him cold and uncomfortable.

A conventional rain trousers after being worn such as by a motorcycle driver riding on a cycle may reveal the foot portion uncovered by the trouser hoses between the shoes and the trousers whereby upon the drainage of rain water, the driver's foot portion may be wet to cause uncomfortableness for the driver.

The present inventor has found the defects of a conventional rain coat and invented the present well-shielded rain clothes.

SUMMARY OF THE INVENTION

The object of the present invention is to provide a rain clothes including a jacket having a pair of gloves built in each sleeve of the jacket and a trousers having each leg hose secured with an elastic hose portion and a foot covering skirt adapted to fasten on a wearer's foot or shoe so that the wearer of the rain clothes will prevent from penetration of rain water into his hands or feet.

DETAILED DESCRIPTION

Figure 4:
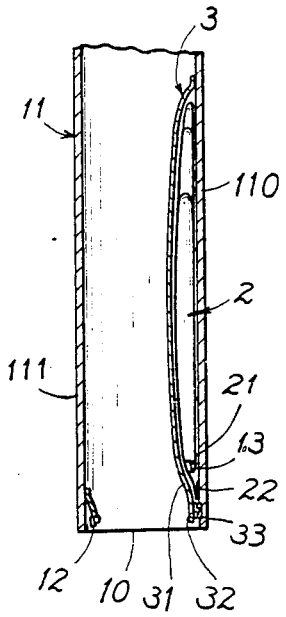
FIG. 4 is a sectional view showing the glove retracted into a bag of the present invention.
Figure 5:
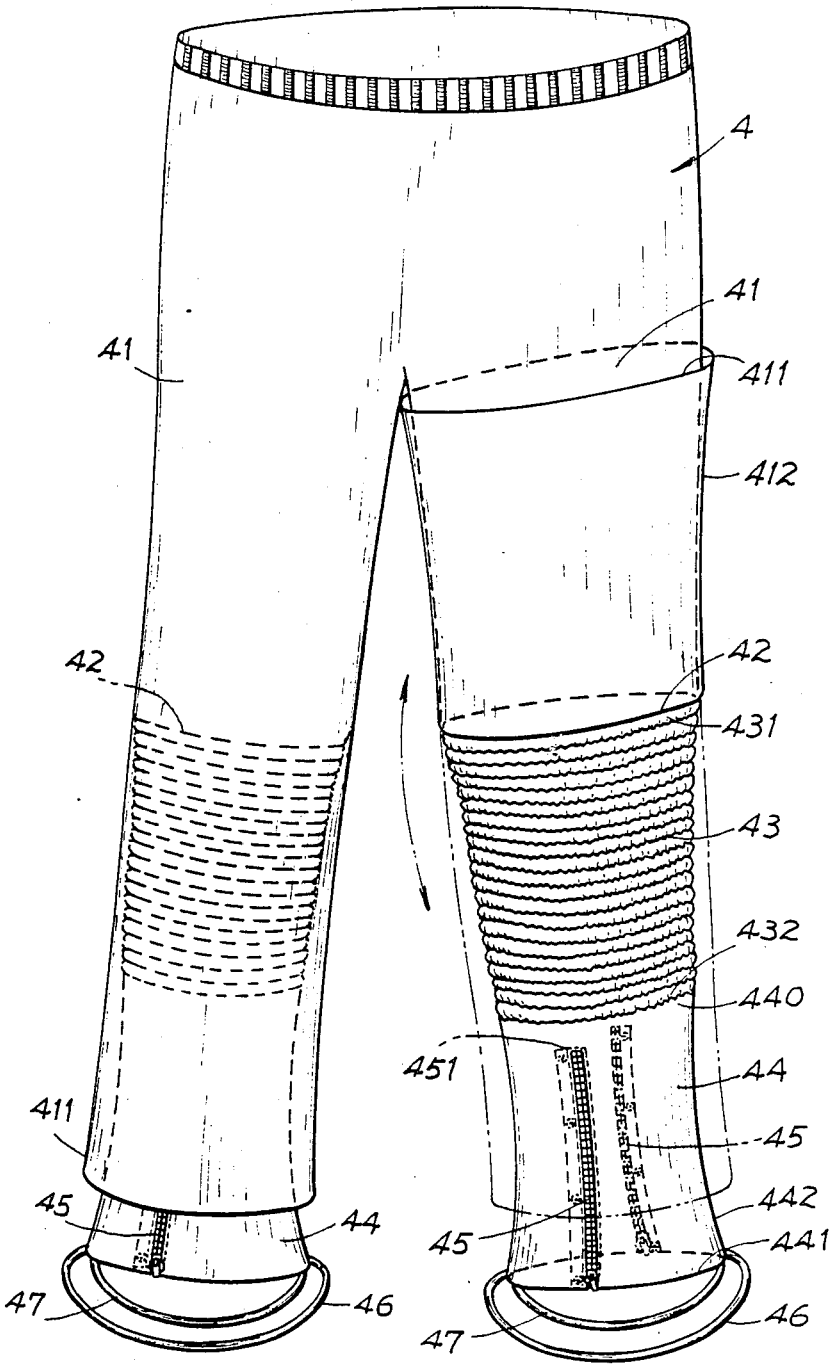
FIG. 5 is an illustration showing a rain trousers in accordance with the present invention.
Figure 6:
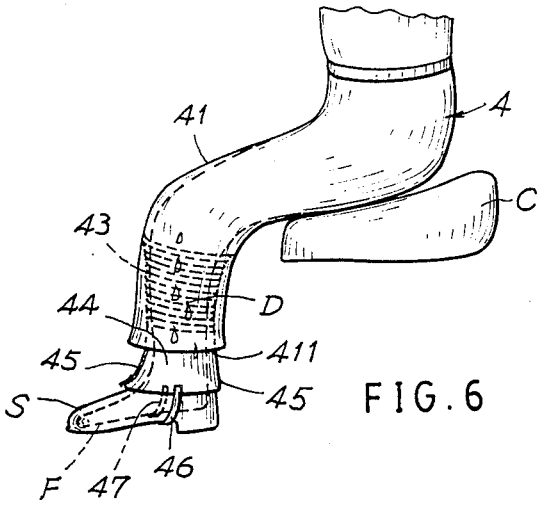
FIG. 6 shows the trousers of the present invention worn by a driver.

The present invention comprises: a rain jacket 1 as shown in FIGS. 1–4 and a rain trousers 4 as shown in FIGS. 5–6.

The rain jacket 1 includes a pair of sleeves 11 each having a glove 2 attached to the sleeve and having a built-in bag 3 formed inside the sleeve adapted for storing the glove 2 when retracted into the sleeve 11.

The glove 2 includes: a left rim portion 21 around a glove opening formed with a flexible strip 13 of a zipper operatively fastened to the other corresponding flexible strip 12 of the zipper as secured to a left half-cover 111 of a sleeve 11 proximate to a sleeve opening 10 by closing a slider 14 of the zipper, and a right rim portion 22 around the glove opening secured to a right half-cover 110 of the sleeve 11 proximate to the sleeve opening 10.

A built-in bag 3 is formed inside the right half-cover 110 of the sleeve 11 and includes a bag cover 31 having a male button 32 formed thereon to operatively engage with a female button hole 33 formed on the right half-cover 110 as positioned between the right rim portion 22 and the sleeve opening 10.

Figure 1:
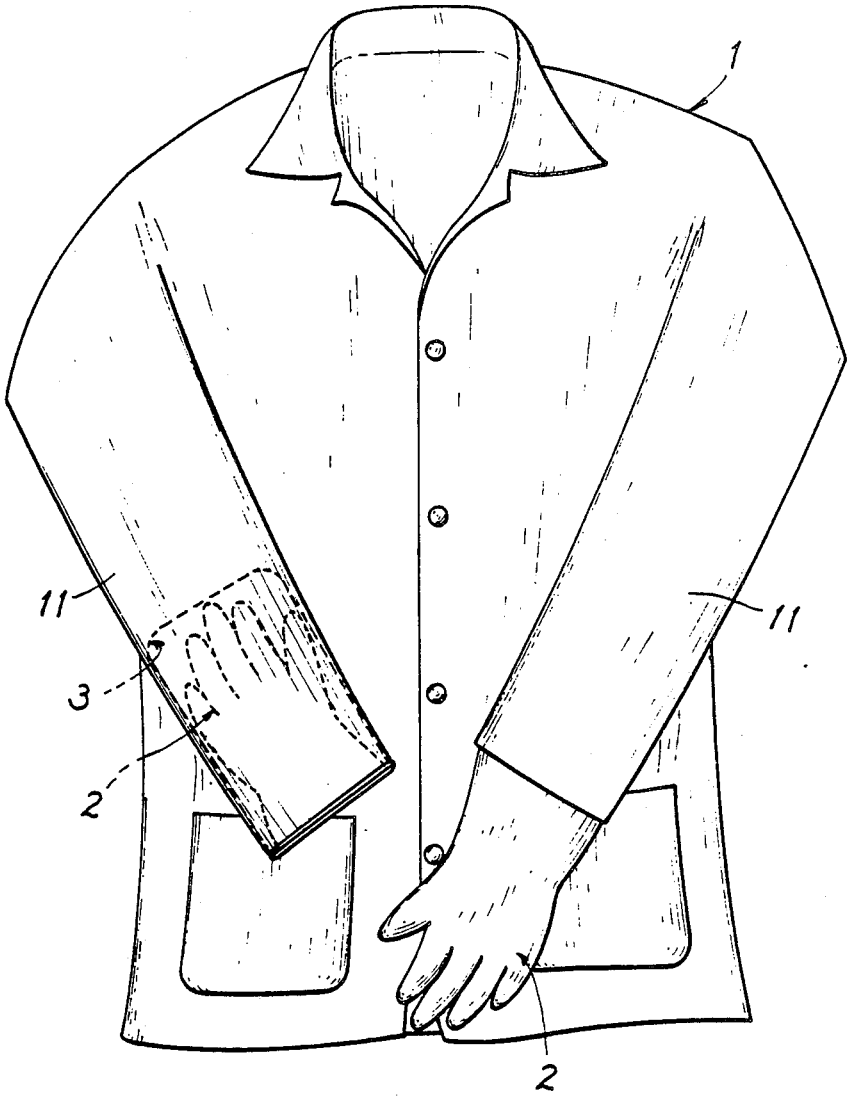
FIG. 1 is an illustration showing a rain jacket in accordance with the present invention.
Figure 2:
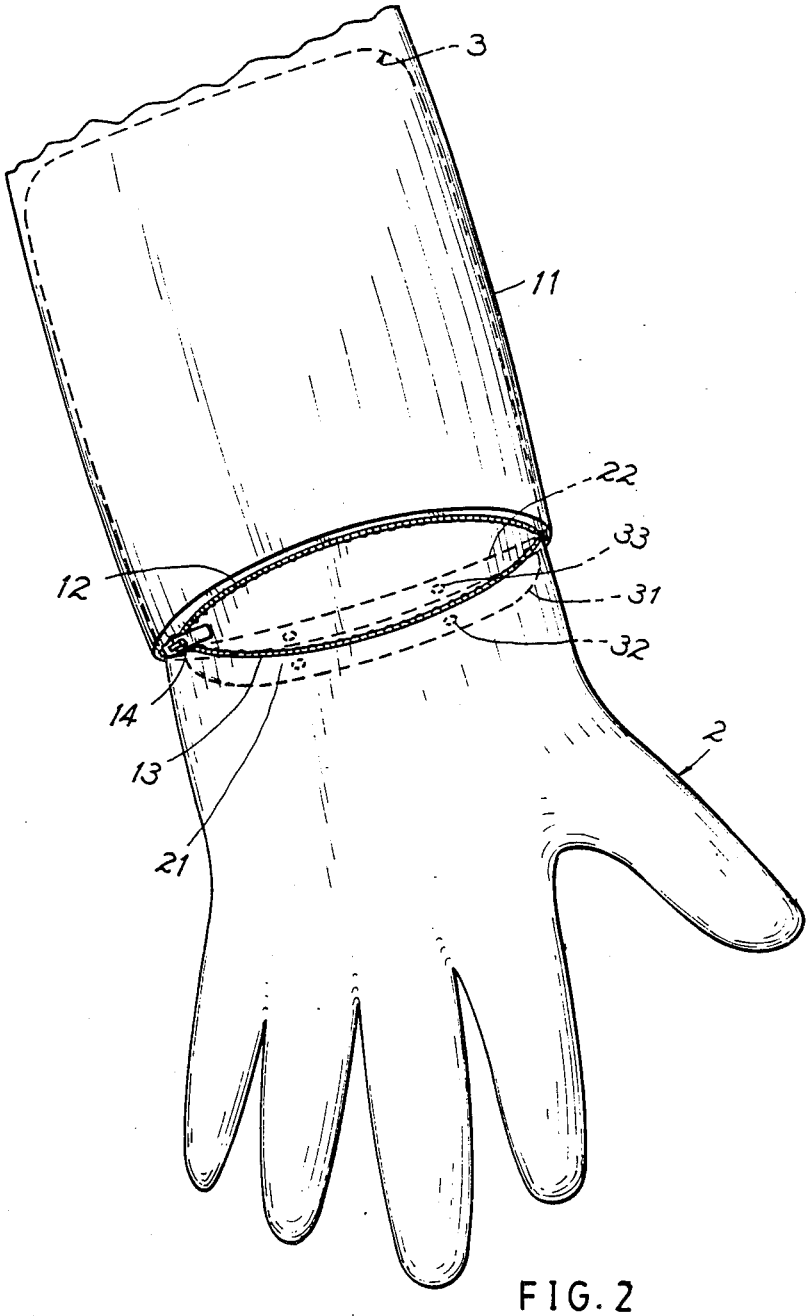
FIG. 2 is a perspective view of the present invention, showing a glove built in a jacket sleeve.
Figure 3:
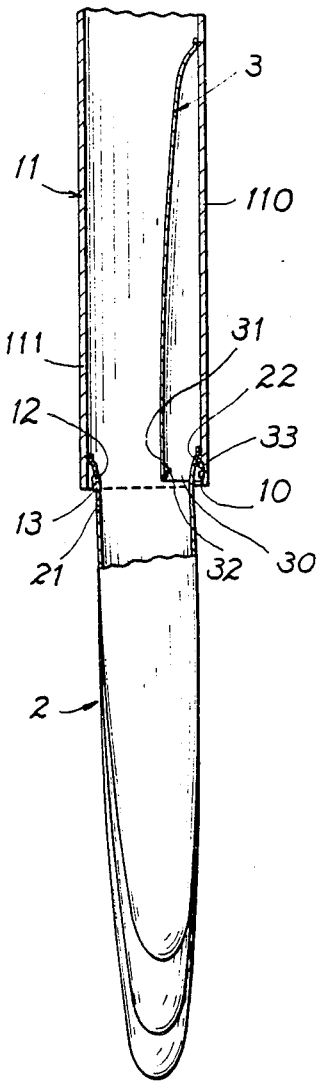
FIG. 3 is a sectional drawing showing the glove secured to the jacket sleeve in accordance with the present invention.

When it is intended to wear the glove 2 as stored in the bag 3 as shown in FIG. 4, the bag cover 31 is opened to withdraw the glove 2 as shown in FIG. 2 and the slider 14 is closed to fasten the two strips 12, 13 to secure the left rim portion 21 to the left half-cover 111 of the sleeve to thereby well secure the glove 2 to the sleeve opening 10 ready for wearing without being wet by any rain water.

When the glove 2 is not used, the zipper 12, 13 can be opened and the glove 2 is then stored into the bag 3 by closing the bag cover 31 by engaging the button 32 with the button hole 33. The glove 2, when not worn, can be concealed in the bag 3 without influencing the wearer's arm movement through the jacket sleeve 11.

The rain trousers 4 includes a pair of leg hoses 41, each having an elastic hose portion 43 secured to an inner perimeter 42 intermediate the hose 41 and having a foot covering skirt 44 secured to the elastic hose portion 43. The elastic hose portion 43 and the foot covering skirt 44 are formed as a lining inside the leg hose 41.

The elastic hose portion 43 includes an upper ring 431 secured to the inner perimeter 42 and a lower ring 432 secured to an upper edge 440 of the covering skirt 44.

The foot covering skirt 44 includes an expansion trumpet portion 442 proximate to its lower opening 441 for covering a shoe upper, a pair of slide fasteners 45 respectively longitudinally formed on both front and rear sides of the skirt 44 each covered by a fastener cover 451 openable for covering a wearer's foot or boot, a shoe belt 46 transversely formed across the lower opening 441 of the skirt 44 adapted for fastening a wearer's shoe sole S (FIG. 6), and a foot belt 47 transversely formed across the opening 441 for fastening a wearer's foot F.

When wearing the trousers 4 of the present invention as shown in FIGS. 5–6, the wearer's leg is poking through each leg hose 41, the elastic hose portion 43 and the covering skirt 44 to allow the foot belt 47 fastening the foot F and allow the shoe belt 46 fastening the shoe S, and the lower outer hose 412 is turned down to cover the elastic portion 43 and the skirt 44 for better appearance so that the wearer, when sitting on seat C as of a motorcycle, can obtain a complete shielding on his foot or lower leg portion to prevent any penetration of rain-water drainage D into the wearer's foot or sock as shown in FIG. 6, since the elastic hose portion 43 can be stretched and elongated to allow the skirt 45 well shielding the wearer's foot as the belts 46, 47 being fastened to the wearer's shoe or foot.

Figure 7:
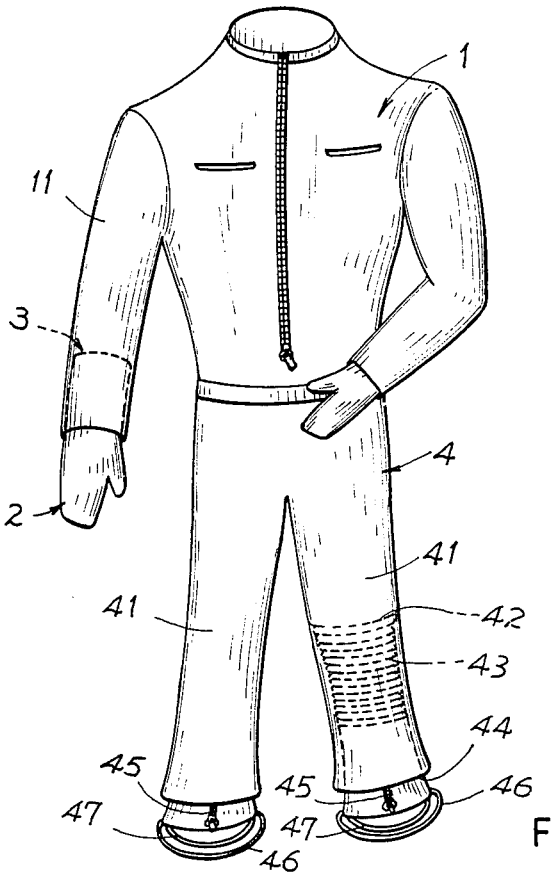
FIG. 7 shows another preferred embodiment of the present invention.

As shown in FIG. 7, an one-piece rain clothes is formed by combining a rain jacket 1 and a trousers 4 as aforementioned.

What is claimed is:

1. A rain clothes comprising:

a rain jacket having a glove secured to each jacket sleeve for wearing use having a built-in bag formed inside each jacket sleeve adapted for storing said glove therein; and a rain trousers including a pair of leg hoses each having an elastic hose portion secured inside each leg hose and a foot covering skirt secured to said elastic hose portion having a shoe belt and a foot belt respectively transversely formed across a lower opening of the skirt adapted to fasten a wearer's shoe and foot, said elastic hose portion and said covering skirt forming a lining inside each said leg hose.

2. A rain clothes according to claim 1, wherein said glove includes a left rim portion around a glove opening formed with a flexible strip of a zipper operatively fastened to a corresponding flexible strip of the zipper as secured to a left half-cover of the jacket sleeve proximate to a sleeve opening, and a right rim portion around the glove opening secured to a right half-cover of said sleeve proximate to the sleeve opening.

3. A rain clothes according to claim 1, wherein said built-in bag is formed inside a right half-cover of said sleeve and includes a bag cover having a male button formed thereon to operatively engage with a female button hole formed on the right half-cover as positioned between the right rim portion of the glove and the sleeve opening.

4. A rain clothes according to claim 1, wherein said foot covering skirt is formed with an expansion trumpet portion proximate to its lower opening and formed with a pair of slide fasteners respectively longitudinally formed on a front and a rear side of said skirt, openable for covering a wearer's boot or foot.

5. A rain clothes according to claim 1, wherein said elastic hose portion has its upper ring secured to an inner perimeter intermediate said leg hose and has its lower ring secured with said skirt whereby upon the turning down of a lower outer hose of the leg hose, the lower outer hose will cover said elastic portion and said skirt.

6. An one-piece rain clothes formed by combining a rain jacket and a rain trousers having the limitations as set forth in claim 1.

* * * * *